US011307000B2

(12) United States Patent
Ma et al.

(10) Patent No.: US 11,307,000 B2
(45) Date of Patent: Apr. 19, 2022

(54) QUICK DETACHING DEVICE FOR HANDGUN TACTICAL LIGHT

(71) Applicant: Shenzhen Olight E-Commerce Technology Co., Ltd., Guangdong (CN)

(72) Inventors: Qiang Ma, Shanxi (CN); Ziyang Zhou, Hubei (CN)

( * ) Notice: Subject to any disclaimer, the term of this patent is extended or adjusted under 35 U.S.C. 154(b) by 0 days.

(21) Appl. No.: 17/129,928

(22) Filed: Dec. 22, 2020

(65) Prior Publication Data

US 2021/0108892 A1 Apr. 15, 2021

(30) Foreign Application Priority Data

May 18, 2020 (CN) ..... 202010420291.5

(51) Int. Cl.
*F41G 11/00* (2006.01)
*F41C 27/00* (2006.01)

(52) U.S. Cl.
CPC ..... *F41G 11/004* (2013.01); *F41C 27/00* (2013.01)

(58) Field of Classification Search
CPC ..... F41G 11/004; F41C 27/00
See application file for complete search history.

(56) References Cited

U.S. PATENT DOCUMENTS 1,899,249 A * 2/1933 Walliser ..... F41G 11/004 248/231.31
2,717,447 A * 9/1955 Leupold ..... F41G 11/001 42/127
3,133,353 A * 5/1964 Williams ..... F41G 1/42 42/141
3,877,166 A * 4/1975 Ward ..... F41G 11/003 42/127
4,860,480 A * 8/1989 Ruger ..... F41G 11/001 42/124
5,155,915 A * 10/1992 Repa ..... F41G 1/383 42/127
5,490,654 A * 2/1996 Herriman ..... F41G 11/001 248/309.1
5,584,137 A * 12/1996 Teetzel ..... F41A 9/62 362/114
5,680,725 A * 10/1997 Bell ..... F41G 11/003 42/127
6,435,738 B1 * 8/2002 Vogt ..... F16M 11/041 396/419

(Continued)

*Primary Examiner* — Michelle Clement
(74) *Attorney, Agent, or Firm* — Prakash Nama; Global IP Services, PLLC

(57) ABSTRACT

This invention provides a quick detaching device for handgun tactical light which includes a tactical light base, two locking members correspondingly disposed on two sides of a top end of the tactical light base, sliding members and a pressing mechanism; a sliding slot is correspondingly mounted in a middle part of each of the sliding members; the sliding members are respectively mounted in the sliding slots; a through slot which passes through the tactical light base is provided in the tactical light base; a stopping plate is provided in a middle part of the through slot; the pressing mechanism is mounted in the through slot and corresponds to the stopping plate. This invention can quickly mount and detach the tactical light without the help of tools and great effort, and is convenient to use.

10 Claims, 5 Drawing Sheets

(56) References Cited

U.S. PATENT DOCUMENTS 6,637,144 B2 * 10/2003 Nelson ..... F41G 1/35 42/120
6,705,038 B2 * 3/2004 Davenport ..... F41G 11/004 42/127
6,922,934 B1 * 8/2005 Huan ..... F41G 11/003 42/127
6,931,779 B1 * 8/2005 Galuppo, Jr. ..... F41G 11/001 42/114
7,107,716 B1 * 9/2006 Liao ..... F41C 27/00 42/108
7,823,316 B2 * 11/2010 Storch ..... F41G 11/003 42/90
8,132,355 B1 * 3/2012 Kincaid ..... F41C 33/041 42/124
8,336,247 B2 * 12/2012 Haering ..... F41G 11/003 42/127
8,393,105 B1 * 3/2013 Thummel ..... F41G 11/003 42/90
8,438,965 B2 * 5/2013 Collin ..... F41G 11/003 89/125
8,567,105 B1 * 10/2013 Bobro ..... F41G 11/003 42/90
8,769,859 B2 * 7/2014 Li ..... F41G 11/003 42/124
8,806,796 B1 * 8/2014 Clifton ..... F41G 11/003 42/90
8,935,875 B2 * 1/2015 Collin ..... F41G 11/003 42/90
9,297,616 B2 * 3/2016 Daniel ..... F41G 11/004
9,459,078 B1 * 10/2016 Kincel ..... F41G 11/004
9,568,281 B1 * 2/2017 Chen ..... F41G 11/003
9,658,031 B1 * 5/2017 Hedeen ..... F41G 1/35
10,024,632 B1 * 7/2018 Oglesby ..... F41C 27/00
10,036,614 B1 * 7/2018 Ruiz ..... F41C 27/00
10,048,040 B1 * 8/2018 Ratliff ..... F41G 11/003
10,107,592 B1 * 10/2018 Huang ..... F41G 1/35
10,371,317 B2 * 8/2019 Chen ..... F16M 13/022
10,415,918 B1 * 9/2019 Paspaliaris ..... F41G 3/12
10,801,814 B2 * 10/2020 Ma ..... F41G 1/35
10,895,436 B2 * 1/2021 Ross ..... F41G 11/003
10,928,051 B1 * 2/2021 Worman ..... F21L 4/00
10,969,201 B1 * 4/2021 Pischke ..... F41G 1/34
11,085,736 B2 * 8/2021 Johnson, Sr. ..... F41G 11/003
11,118,859 B1 * 9/2021 Hawk ..... F21V 23/0414
2002/0104249 A1 * 8/2002 Lin ..... F41G 11/004 42/114
2003/0101632 A1 * 6/2003 Davenport ..... F41G 11/004 42/85
2005/0041966 A1 * 2/2005 Johnson ..... F16M 11/041 396/428
2006/0117636 A1 * 6/2006 Newhall ..... F41G 11/003 42/124
2007/0234623 A1 * 10/2007 Carney ..... F41G 11/003 42/95
2008/0168696 A1 * 7/2008 Orne ..... F41A 35/00 42/90
2008/0178511 A1 * 7/2008 Storch ..... F41C 27/00 42/90
2008/0244953 A1 * 10/2008 Kilic ..... F41G 11/003 42/127
2010/0229448 A1 * 9/2010 Houde-Walter ..... F41C 23/16 42/72
2011/0047851 A1 * 3/2011 Mock ..... F41G 1/35 42/72
2011/0058362 A1 * 3/2011 Sun ..... F41G 1/35 362/187
2011/0067287 A1 * 3/2011 Collin ..... F41G 11/003 42/119
2011/0076095 A1 * 3/2011 Storch ..... F41G 11/003 403/322.4
2011/0146128 A1 * 6/2011 Haering ..... F41G 11/003 42/90
2011/0247255 A1 * 10/2011 Ding ..... F41G 11/003 42/90
2012/0167436 A1 * 7/2012 Westra ..... F41G 11/004 42/90
2012/0167438 A1 * 7/2012 Daniel ..... F41G 11/004 42/90
2012/0198745 A1 * 8/2012 Riley ..... F41C 27/00 42/90
2012/0268920 A1 * 10/2012 Matthews ..... F41G 11/003 362/110
2013/0104441 A1 * 5/2013 Kincel ..... F41G 11/004 42/90
2013/0156495 A1 * 6/2013 Li ..... F41G 11/001 403/322.4
2013/0160345 A1 * 6/2013 Li ..... F41G 11/001 42/124
2014/0137457 A1 * 5/2014 Collin ..... F41G 11/003 42/90
2014/0196348 A1 * 7/2014 Samson ..... F41C 27/00 42/90
2014/0252187 A1 * 9/2014 Petrovic ..... F16B 2/185 248/229.16
2014/0305021 A1 * 10/2014 Prieto ..... F41G 11/003 42/111
2015/0068095 A1 * 3/2015 Collin ..... F41G 11/003 42/90
2015/0159847 A1 * 6/2015 Galli ..... F41G 1/35 362/111
2015/0362291 A1 * 12/2015 Samson ..... F41G 11/004 42/90
2016/0202022 A1 * 7/2016 Gao ..... F41G 11/003 42/90
2017/0038177 A1 * 2/2017 Sun ..... F41G 1/345
2017/0045334 A1 * 2/2017 Yim ..... F16M 13/02
2017/0082402 A1 * 3/2017 Zimmer ..... F41G 11/001
2018/0142991 A1 * 5/2018 Rogers ..... F41G 11/004
2018/0202769 A1 * 7/2018 Kolvek ..... F41C 27/00
2018/0259298 A1 * 9/2018 Gao ..... F16B 2/185
2018/0283670 A1 * 10/2018 Galli ..... F41G 1/36
2018/0340754 A1 * 11/2018 Cosentino ..... F41G 11/003
2018/0340755 A1 * 11/2018 Cosentino ..... F41G 11/003
2018/0347950 A1 * 12/2018 Swan ..... F41G 11/003
2018/0364009 A1 * 12/2018 Hancosky ..... F41G 1/35
2019/0011225 A1 * 1/2019 Sun ..... F41G 1/545
2019/0078853 A1 * 3/2019 Johnson, Sr. ..... F41A 25/14
2019/0128470 A1 * 5/2019 Johnson, Sr. ..... F16M 11/041
2019/0162362 A1 * 5/2019 Chen ..... F16B 2/18
2019/0219365 A1 * 7/2019 Ma ..... F41G 11/003
2019/0226799 A1 * 7/2019 Hubbell ..... F41C 27/00
2019/0234710 A1 * 8/2019 Batenhorst ..... F41G 11/004
2019/0242677 A1 * 8/2019 Ding ..... F41G 11/003
2019/0249696 A1 * 8/2019 Larue ..... F41G 11/003
2019/0249948 A1 * 8/2019 Cahill ..... F41G 11/004
2019/0277601 A1 * 9/2019 Hanley ..... F41G 11/001
2019/0285386 A1 * 9/2019 Burt ..... F41G 11/004
2019/0301835 A1 * 10/2019 Tayon ..... F41G 1/35
2019/0331460 A1 * 10/2019 Johnson, Sr. ..... F41G 11/003
2020/0025522 A1 * 1/2020 Zimmer ..... F41G 11/003
2020/0049454 A1 * 2/2020 Leutzinger ..... F41G 1/35
2020/0200508 A1 * 6/2020 Teetzel ..... F41G 11/003
2020/0240750 A1 * 7/2020 Reed ..... F21V 23/04
2020/0256645 A1 * 8/2020 Galli ..... F41G 1/35
2021/0108891 A1 * 4/2021 Ma ..... F41G 11/003
2021/0108892 A1 * 4/2021 Ma ..... F41C 27/00

* cited by examiner

QUICK DETACHING DEVICE FOR HANDGUN TACTICAL LIGHT

BACKGROUND OF THE INVENTION

The present invention belongs to the technical field of portable lighting apparatus and more particularly pertains to a quick detaching device for handgun tactical light.

When a common tactical light is in use, it is necessary to first loosen the nut and then open the clamping mechanism before the tactical light could be detached. This kind of design is inconvenient in that the tactical light could only be detached by hand with great strength or with tools. In outdoor environment where there is no tools or when the user does not have sufficient strength, user operation is very inconvenient and the detaching process takes relatively long time. Besides, tactical lights are equipped with charging function. When the battery of the tactical light runs out and requires charging, frequency would be higher and the detaching process is troublesome. It is even more troublesome when the user wishes to use the tactical light as a torch. This results in increased difficulty in user operation and bad experience. Therefore, it is necessary to provide a quick detaching device for handgun tactical light which can quickly mount and detach a tactical light without the help of tools and great effort.

BRIEF SUMMARY OF THE INVENTION

In view of the aforesaid disadvantages now present in the prior art, the present invention provides a quick detaching device for handgun tactical light.

The present invention is achieved by the following technical solutions:

A quick detaching device for handgun tactical light comprises a tactical light base, two locking members correspondingly disposed on two sides of a top end of the tactical light base, sliding members and a pressing mechanism; a sliding slot is correspondingly mounted in a middle part of each of the locking members; the sliding members are respectively mounted in the sliding slots; a through slot which passes through the tactical light base is provided in the tactical light base; a stopping plate is provided in a middle part of the through slot; the pressing mechanism is mounted in the through slot and corresponds to the stopping plate.

A top end of the through slot is in corresponding communication with the tactical light base.

A mounting hole is provided on each of upper and lower sides of a middle part of each of the sliding slots; each of the sliding members is connected with the corresponding mounting holes.

Each of the sliding members comprises a spring plate, a rotating shaft, a first roller and a second roller; a fixing hole is provided at a middle part of the spring plate; a U-shaped slot is provided at each of two ends of the spring plate; the first roller and the second roller are mounted in the U-shaped slots respectively; the rotating shaft passes through the fixing hole and correspondingly connects with the two mounting holes on the two sides.

The pressing mechanism comprises a push rod, an elastic member, a sliding block and a fixing nut; the sliding block is in corresponding contact with a first end of the stopping plate; the elastic member is in corresponding contact with a second end of the stopping plate; the fixing nut is in corresponding contact with the sliding block; the push rod sequentially passes through the elastic member, the stopping plate and the sliding block to be in corresponding contact with the fixing nut.

The push rod comprises a strip-shaped pressing strip, a connecting rod and a threaded rod; the pressing strip has a cross section which is identical to cross section of the through slot; the pressing strip has a first end which is connected to a first end of the connecting rod and a second end which is exposed outside the tactical light base; a second end of the connecting rod is correspondingly connected with the threaded rod; the threaded rod is correspondingly connected with the fixing nut;

The sliding block is movable in the through slot; the sliding block comprises a rectangular body, a strip-shaped limiting protrusion and a connecting hole; the body is correspondingly connected with the through slot; the limiting protrusion is disposed on a top part of the body; the connecting hole passes through the body; the limiting protrusion has a first end which is provided with a trapezium-shaped block.

The connecting rod has an outer diameter which is smaller than an aperture diameter of the elastic member; the elastic member is sleeved on the connecting rod; the connecting rod sequentially passes through the elastic member and the stopping plate.

The threaded rod has an outer diameter which is smaller than an aperture diameter of the connecting hole; the connecting rod has an outer diameter which is larger than the aperture diameter of the connecting hole; the threaded rod passes through the connecting hole to correspondingly connect with the fixing nut.

The spring plate is made of a polymer material which comprises the following components in parts by mass:

| | |
|---|---|
| Ceramic powder | 15-40 parts, |
| Carbon fiber | 60-90 parts, |
| Epoxy resin | 20-30 parts, |
| Adjuvant | 20-30 parts. |

The adjuvant comprises 10-15 parts of plasticizer and 15-20 parts of a curing agent in parts by mass; the plasticizer is a mixture of phthalic anhydride and trimellitic anhydride; the curing agent is diaminodichlorodiphenylmethane; the ceramic powder comprises polyurethane resin with a mass fraction of 15-17% and TiN with a mass fraction of 9-11%; the polyurethane resin is prepared by toluene diisocyanate as raw material.

The beneficial effects of the present invention are as follows:

1. When the quick detaching device for handgun tactical light is in use, grip the tactical light and align it with the sliding slot of the handgun, then snap the limiting protrusion of the sliding block in the notch of the handgun to mount the tactical light on the handgun. To detach the tactical light, press the pressing strip to move the connecting rod so as to push the sliding block on the other end of the connecting rod to move outwards; as a result, the limiting protrusion of the sliding block is disengaged from the notch of the handgun and thereby unlocking the tactical light; at this time, pull the tactical light outwards to detach the tactical light from the handgun.

2. In the quick detaching device for handgun tactical light of the present invention, the operation method for detaching the tactical light is completely different from the threaded connection structure in the prior art. It can quickly mount and detach the tactical light without the help of tools or great effort, and it is convenient to use.

3. The spring plate of the quick detaching device for handgun tactical light has the ability to restore to its initial state after external force is removed. With the addition of carbon fiber, it has the characteristics of high temperature resistance, anti-friction, and it is electrically conductive, heat conductive, and anti-corrosive. Carbon fiber is low in density, so the specific strength and the specific modulus are high. Carbon fiber as a reinforcing material combines with epoxy resin and ceramic powder, and the manufactured material has a significantly higher specific strength and specific modulus than existing material. With the addition of ceramic powder, the material of the present invention has the characteristics of anti-friction and high hardness. As the present invention is added with polyurethane resin and TiN, the anti-abrasiveness of the material is greatly increased. With the addition of plasticizer, the processability of the material is increased, and the plasticizer uses mixedanhydride by-product, thus reducing waste discharge and protecting the environment.

4. The polyurethane resin of the spring plate of the quick detaching device for handgun tactical light is prepared by toluene diisocyanate as raw material. Toluene diisocyanate easily reacts with compositions containing active hydrogen atom, and reacts with diol to form liner polyurethane or polyurethane resin. Polyurethane elastomer is a high molecular synthetic material with a large quantity of carbamate groups on the major chain. It is mainly formed by reaction of polyol, polyisocyanate and chain extender. It has a large variety of raw materials and compositions, and has a wide adjustable range. Due to the thermodynamic incompatibility between the soft segment and the hard segment, the soft segment and the hard segment can form independent micro areas by dispersion and clustering having micro-phase separated structure, thereby endowing the polyurethane elastomer with excellent mechanical properties. It has a wide hardness adjustable range, excellent anti-abrasive property, and is therefore widely used as an anti-abrasive material. However, the anti-abrasive property of polyurethane could be affected by various factors. The present invention uses toluene diisocyanate as a major raw material for preparing the polyurethane resin so as to significantly increase the anti-abrasiveness of the material.

References in the figures: 1—tactical light base; 2—locking member; 3—sliding slot; 4—through slot; 5—stopping plate; 6—mounting hole; 7—spring plate; 8—rotating shaft; 9—first roller; 10—second roller; 11—fixing hole; 12—U—shaped slot; 13—push rod; 131—pressing strip; 132—connecting rod; 133—threaded rod; 14—elastic member; 15—sliding block; 151—body; 152—limiting protrusion; 153—connecting hole; 154—block; 16—fixing nut.

DETAILED DESCRIPTION OF THE INVENTION

A preferred embodiment of the present invention is described below with the accompanying drawings.

Figure 1:
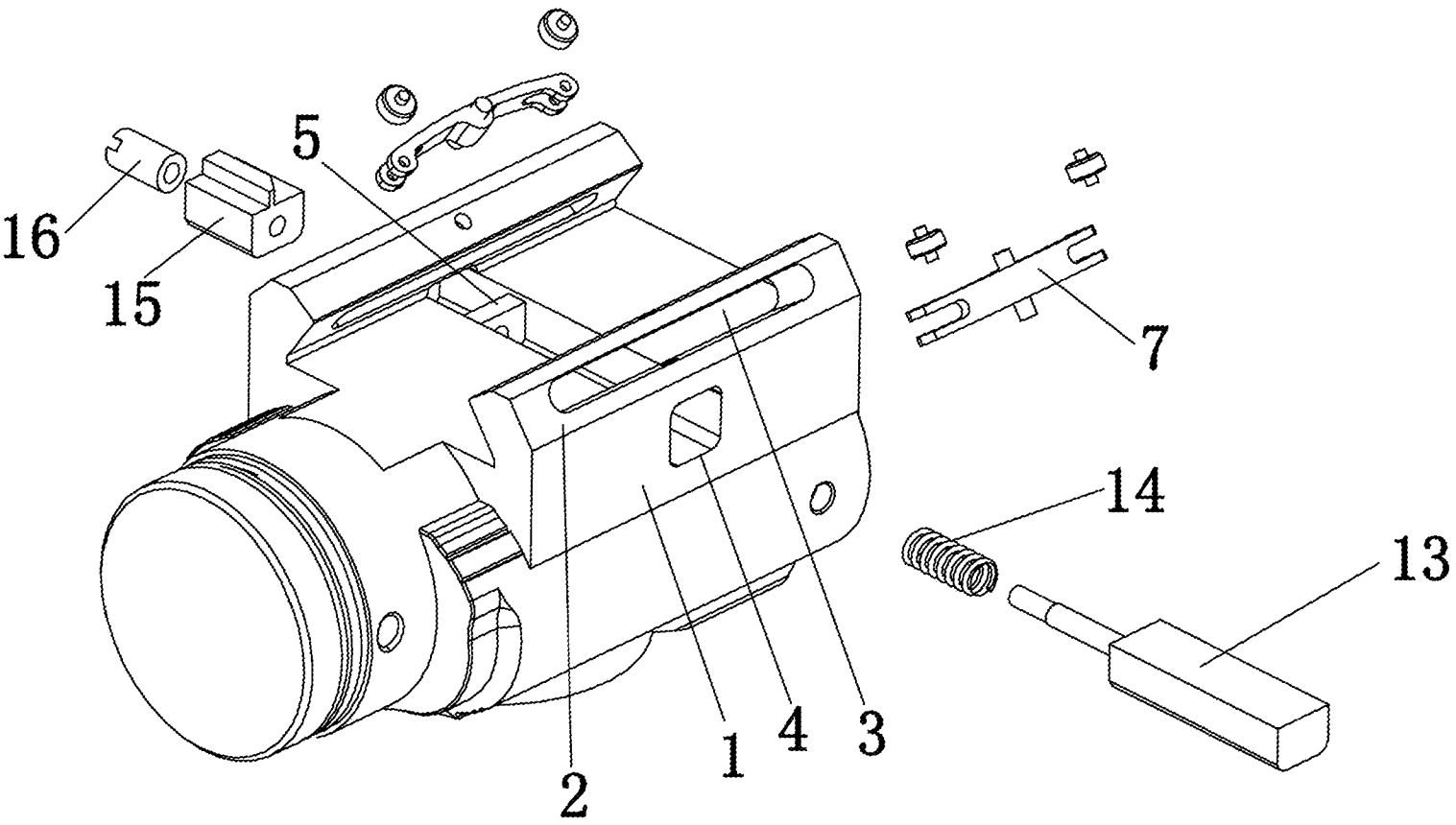
FIG. 1 is an exploded view of the quick detaching device of the handgun tactical light of the present invention.

As illustrated in FIG. 1, the quick detaching device for handgun tactical light comprises a tactical light base 1, two locking members 2 correspondingly disposed on two sides of a top end of the tactical light base 1, sliding members and a pressing mechanism. A sliding slot 3 is correspondingly mounted in a middle part of each of the locking members 2 respectively. The sliding members are respectively mounted in the sliding slots 3. A through slot 4 which passes through the tactical light base 1 is provided in the tactical light base 1. The through slot 4 has a top end which is in corresponding communication with the tactical light base 1. A stopping plate 5 is provided in a middle part of the through slot 4. The pressing mechanism is mounted in the through slot 4 and corresponds to the stopping plate 5. The present invention could be mounted on common handguns. A common handgun is provided with a sliding slot on top for hanging various auxiliary apparatus, and is provided with 1 to 3 notches for preventing the auxiliary apparatus from dropping. The pressing mechanism can slide in the through slot 4 so that a sliding block of the pressing mechanism snaps to the notch to achieve locking of the present invention to the handgun; in other words, the tactical light can be mounted on the handgun.

Figure 2:
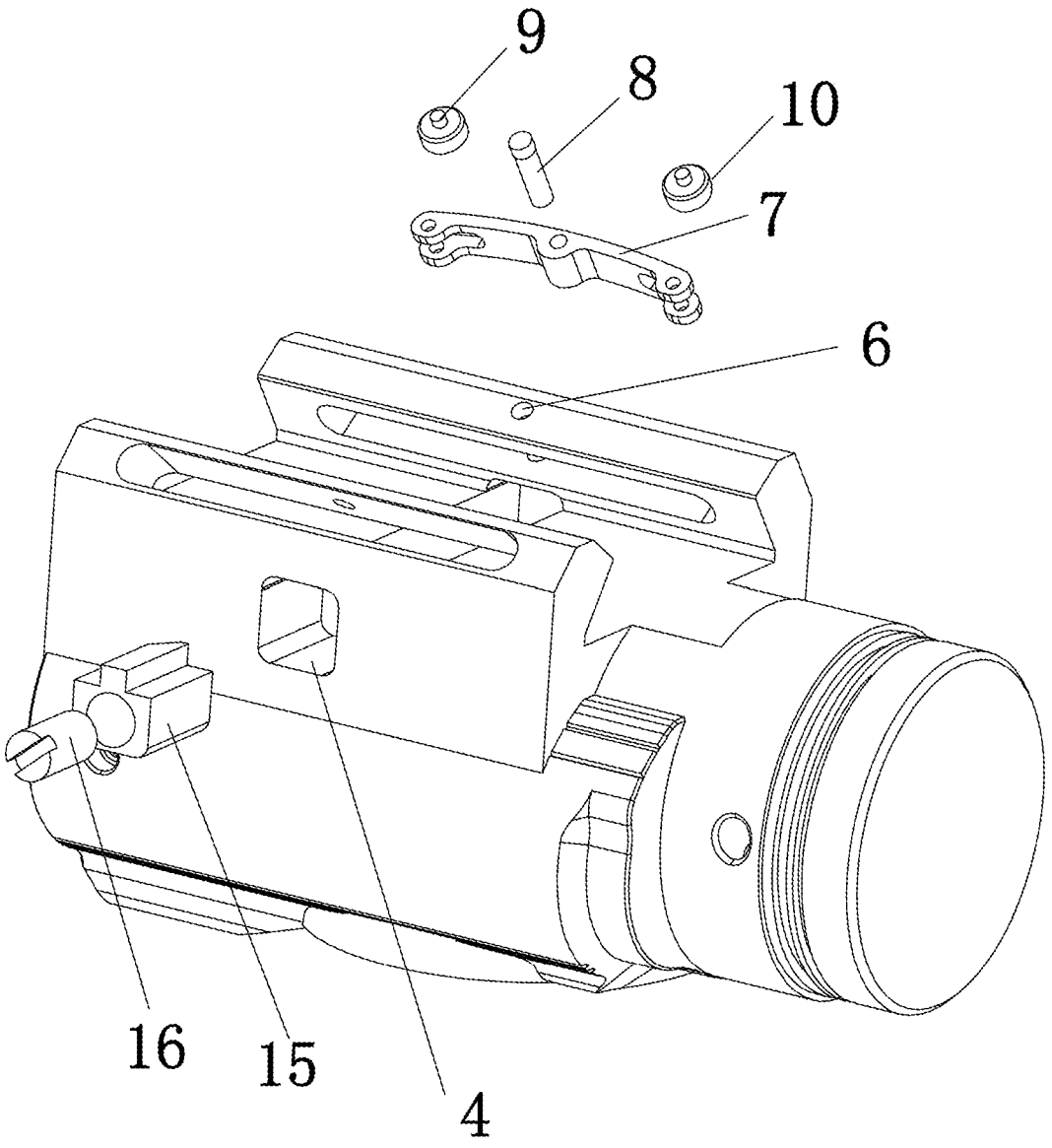
FIG. 2 is an exploded view of the quick detaching device of the handgun tactical light of the present invention in another perspective.
Figure 3:
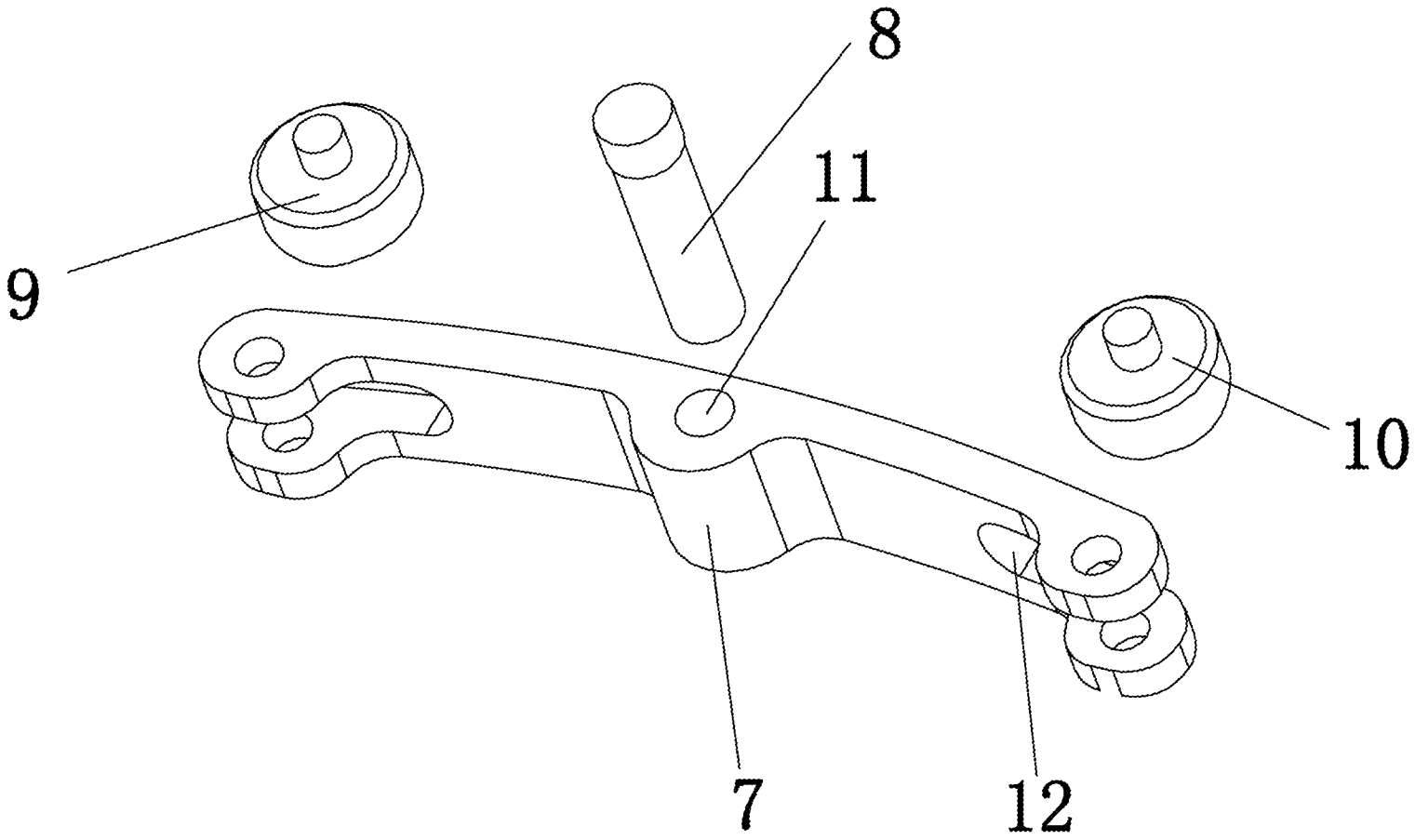
FIG. 3 is a schematic structural view of the sliding member of the quick detaching device of the handgun tactical light of the present invention.

As illustrated in FIGS. 2 to 3, a mounting hole 6 is provided on each of upper and lower sides of a middle part of each of the sliding slots 3. Each of the sliding members is connected with the corresponding mounting holes 6. Each of the sliding members comprises a spring plate 7, a rotating shaft 8, a first roller 9 and a second roller 10. A fixing hole 11 is provided at a middle part of the spring plate 7. A U-shaped slot 12 is provided at each of two ends of the spring plate 7. The first roller 9 and the second roller 10 are mounted in the U-shaped slots 12 respectively. The rotating shaft 8 passes through the fixing hole 11 and correspondingly connects with the two mounting holes 6 on the two sides. The spring plate 7 is made by processing elastic material, which is then subject to heat treatment to enhance elasticity. Two ends of the spring plate 7 which are provided with the U-shaped slots 12 are both provided with through holes for fixedly connecting with the first roller 9 and the second roller 10. A small shaft is provided in each of the first roller 9 and the second roller 10. The small shaft has a first end which is knurled to connect with one of the through holes of the U-shaped slot 12 by rivet connection and a second end which passes through the first roller 9 or the second roller 10 to mount the roller in the U-shaped slot 12 and is fixedly connected to the other one of the through holes, thereby limiting the first roller 9 and the second roller 10 in the spring plate 7. The first roller 9 and the second roller 10 can roll freely.

The rotating shaft 8 has a first end which is knurled to connect with one of the mounting holes 6 on the sliding slot 3 by rivet connection and a second end which passes through the fixing hole 11 of the spring plate 7 to mount the spring plate in the sliding slot 3 and is fixedly connected to the other one of the mounting holes 6, thereby limiting the spring plate 7 in the sliding slot 3.

The present invention provides the sliding members in the locking members 2 on two sides of the tactical light base 1.

The first roller 9 and the second roller 10 of each of the sliding members connect with the corresponding sliding slot of the handgun, thereby reducing the contact area between the locking members 2 on two sides and the handgun, as well as the friction force between the locking members 2 and the handgun, so that it is more effort-saving for users to mount and detach the tactical light. Besides, when the tactical light base is pulled, the first rollers 9 and the second rollers 10 roll in the sliding slots of the handgun, thus further reducing the effort for mounting and detaching the tactical light. Furthermore, the spring plates 7 are made with elastic material to prevent the first rollers 9 and the second rollers 10 from being stuck when rolling in the sliding slots of the handgun; once the present invention is detached from the handgun, the spring plates 7 are restored so that the first rollers 9 and the second rollers 10 can be inserted into the sliding slots of the handgun in time.

As illustrated in FIG. 1, the pressing mechanism comprises a push rod 13, an elastic member 14, a sliding block 15 and a fixing nut 16. The sliding block 15 is in corresponding contact with a first end of the stopping plate 5. The elastic member 14 is in corresponding contact with a second end of the stopping plate 5. The fixing nut 16 is in corresponding contact with the sliding block 15. The push rod 13 sequentially passes through the elastic member 14, the stopping plate 5 and the sliding block 15 to be in corresponding contact with the fixing nut 16. The elastic member 14 has a first end which abuts against the stopping plate 5 in the through slot 4 and a second end which abuts against the push rod 13 for driving the sliding block 15 and the push rod 13 to restore to their initial positions.

Figure 5:
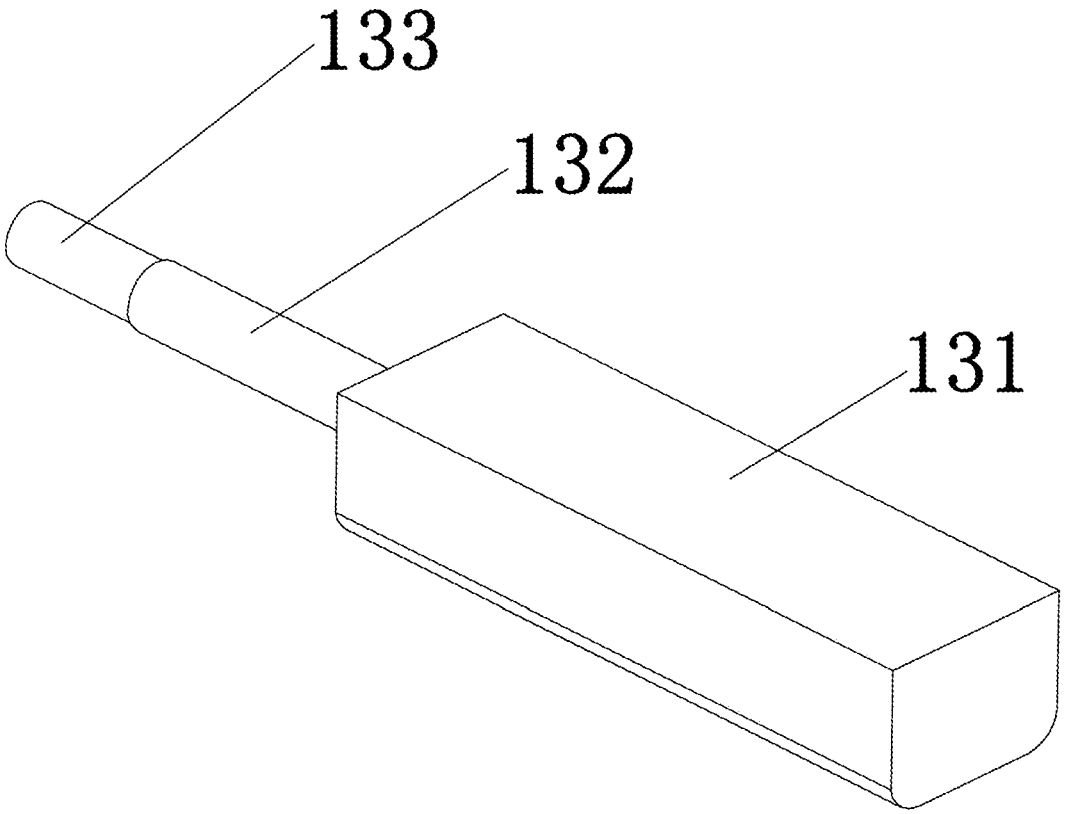
FIG. 5 is a schematic structural view of the push rod of the quick detaching device of the handgun tactical light of the present invention.

As illustrated in FIG. 5, the push rod 13 comprises a strip-shaped pressing strip 131, a connecting rod 132 and a threaded rod 133. The pressing strip 131 has a cross section which is identical to cross section of the through slot 4. The pressing strip 131 has a first end which is connected to a first end of the connecting rod 132 and a second end which is exposed outside the tactical light base 1. A second end of the connecting rod 132 is correspondingly connected to the threaded rod 133. The threaded rod 133 is correspondingly connected to the fixing nut 16. The connecting rod 132 has an outer diameter which is smaller than an aperture diameter of the elastic member 14. The elastic member 14 is sleeved on the connecting rod 132. The connecting rod 132 sequentially passes through the elastic member 14 and the stopping plate 5.

Figure 4:
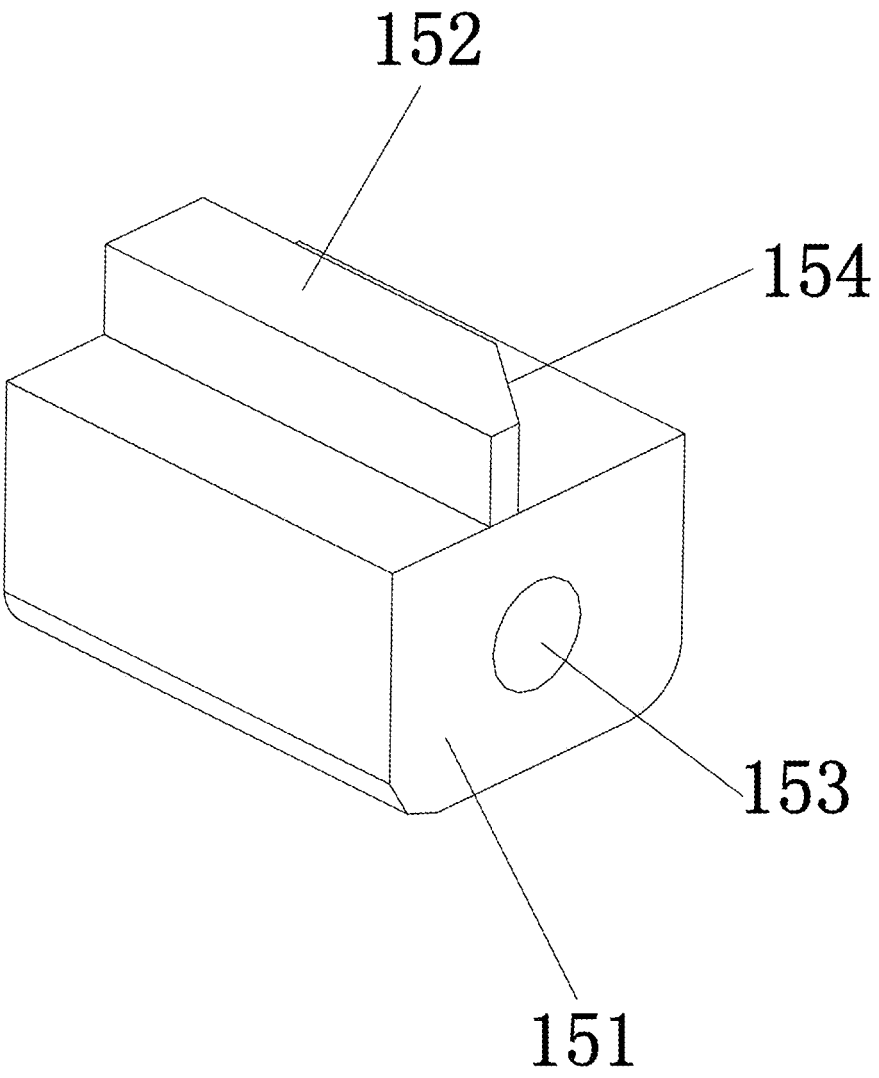
FIG. 4 is a schematic structural view of the sliding block of the quick detaching device of the handgun tactical light of the present invention.

As illustrated in FIG. 4, the sliding block 15 is movable in the through slot 4. The sliding block 15 comprises a rectangular body 151, a strip-shaped limiting protrusion 152 and a connecting hole 153. The body 151 is correspondingly connected with the through slot 4. The limiting protrusion 152 is disposed on a top part of the body 151. The connecting hole 153 passes through the body 151. The limiting protrusion 152 has a first end which is provided with a trapezium-shaped block 154. The block 154 facilitates insertion of the limiting protrusion 152 to the notch of the handgun. Mounting and detaching of the present invention can therefore be done rapidly.

As illustrated in FIGS. 4 and 5, the threaded rod 133 has an outer diameter which is smaller than an aperture diameter of the connecting hole 153. The connecting rod 132 has an outer diameter which is longer than the aperture diameter of the connecting hole 153. The threaded rod 133 passes through the connecting hole 153 to correspondingly connect with the fixing nut 16. The sliding block 15 is fixed on the threaded rod 133 by the fixing nut 16. The sliding block 15 is thereby prevented from moving to the connecting rod 132. As a result, when the push rod 13 is pushed, the limiting protrusion 152 could not be detached from the notch of the handgun in time.

When the present invention is not yet mounted to the handgun, under the action of the elastic member 14 of the pressing mechanism, the sliding block 15 is in contact with the stopping plate 5. The limiting protrusion 152 protrudes from the through slot 4. When in use, grip the tactical light and align the first rollers 9 and the second rollers 10 of the locking blocks 2 on two sides of the tactical light base 1 to the sliding slots on the handgun; push the present invention forcefully so that the limiting protrusion 152 of the sliding block 15 is inserted in the notch of the handgun, thereby completing mounting of the tactical light on the handgun. To detach the tactical light, push the pressing strip 131 so that the stopping plate 5 compresses the elastic member 14, and the connecting rod 132 is moved and thereby driving the sliding block 15 on the other end of the connecting rod 132 to move outwards; as a result, the sliding block 15 is disengaged from the stopping plate 5; then detach the limiting protrusion 152 of the sliding block 15 from the notch of the handgun to unlock the tactical light; at this time, pull the tactical light outwards to detach the tactical light from the handgun; under the action of the elastic member 14, the push rod 13 moves outwards to restore to its initial state, and the connecting rod then drives the sliding block to move outwards until the sliding block 15 is in contact with the stopping plate 5. During actual use, the position of the stopping plate 5 in the through slot 4 needs to be the same as the position of the notch of the handgun, so that the limiting protrusion 152 of the sliding block 15 can be inserted in the notch.

The spring plate 7 is made of a high molecular material which comprises the following components in parts by mass:

| | |
|---|---|
| Ceramic powder | 15-40 parts; |
| Carbon fiber | 60-90 parts; |
| Epoxy resin | 20-30 parts; |
| Adjuvant | 20-30 parts. |

The adjuvant comprises 10-15 parts of plasticizer and 15-20 parts of a curing agent in parts by mass. The plasticizer is a mixture of phthalic anhydride and trimellitic anhydride. The curing agent is diaminodichlorodiphenylmethane. The ceramic powder comprises polyurethane resin with a mass fraction of 15-17% and TiN with a mass fraction of 9-11%. The polyurethane resin is prepared by toluene diisocyanate as raw material.

The spring plate of the quick detaching device for handgun tactical light of the present invention has the ability to restore to its initial state after external force is removed. With the addition of carbon fiber, it has the characteristics of high temperature resistance, anti-friction, and it is electrically conductive, heat conductive, and anti-corrosive. Carbon fiber is low in density, so the specific strength and the specific modulus are high. Carbon fiber as a reinforcing material combines with epoxy resin and ceramic powder, and the manufactured material has a significantly higher specific strength and specific modulus than existing material. With the addition of ceramic powder, the material of the present invention has the characteristics of anti-friction and high hardness. As the present invention is added with polyurethane resin and TiN, titanium nitride (TiN) has typical NaCl structure and has the features of high melting point, high hardness, and high chemical stability. With the addition of TiN in the material of the present invention, it can provide the material with the core of anti-abrasiveness, which greatly increases the anti-abrasiveness of the material of the present invention. With the addition of plasticizer, the processability of the material is increased, and the plasticizer uses mixedanhydride by-product, thus reducing waste discharge and protecting the environment.

The structure, principle and operating process of the connection and fixing means of the present invention and the handgun are available in the prior art and are therefore not detailed herein.

Although the technical proposal of the present invention has already been described in a relatively detailed manner, it should be understood that to a person skilled in the art, ordinary changes and replacements made within the scope of teachings of the present invention by a person skilled in the art should also fall within the scope of the present invention.

What is claimed is:

1. A quick detaching device for handgun tactical light comprises a tactical light base (1), two locking members (2) correspondingly disposed on two sides of a top end of the tactical light base (1), sliding members and a pressing mechanism, wherein a sliding slot (3) is correspondingly mounted in a middle part of each of the locking members (2); the sliding members are respectively mounted in the sliding slots (3); a through slot (4) which passes through the tactical light base (1) is provided in the tactical light base (1); a stopping plate (5) is provided in a middle part of the through slot (4); the pressing mechanism is mounted in the through slot (4) and corresponds to the stopping plate (5).

2. The quick detaching device for handgun tactical light as in claim 1, wherein a top end of the through slot (4) is in corresponding communication with the tactical light base (1).

3. The quick detaching device for handgun tactical light as in claim 1, wherein a mounting hole (6) is provided on each of upper and lower sides of a middle part of each of the sliding slots (3); each of the sliding members is connected with the corresponding mounting holes (6).

4. The quick detaching device for handgun tactical light as in claim 3, wherein each of the sliding members comprises a spring plate (7), a rotating shaft (8), a first roller (9) and a second roller (10); a fixing hole (11) is provided at a middle part of the spring plate (7); a U-shaped slot (12) is provided at each of two ends of the spring plate (7); the first roller (9) and the second roller (10) are mounted in the U-shaped slots (12) respectively; the rotating shaft (8) passes through the fixing hole (11) and correspondingly connects with the two mounting holes (6) on the two sides.

5. The quick detaching device for handgun tactical light as in claim 1, wherein the pressing mechanism comprises a push rod (13), an elastic member (14), a sliding block (15) and a fixing nut (16); the sliding block (15) is in corresponding contact with a first end of the stopping plate (5); the elastic member (14) is in corresponding contact with a second end of the stopping plate (5); the fixing nut (16) is in corresponding contact with the sliding block (15); the push rod (13) sequentially passes through the elastic member (14), the stopping plate (5) and the sliding block (15) to be in corresponding contact with the fixing nut (16).

6. The quick detaching device for handgun tactical light as in claim 5, wherein the push rod (13) comprises a strip-shaped pressing strip (131), a connecting rod (132) and a threaded rod (133); the pressing strip (131) has a cross section which is identical to cross section of the through slot (4); the pressing strip (131) has a first end which is connected to a first end of the connecting rod (132) and a second end which is exposed outside the tactical light base (1); a second end of the connecting rod (132) is correspondingly connected with the threaded rod (133); the threaded rod (133) is correspondingly connected with the fixing nut (16);

the sliding block (15) is movable in the through slot (4);

the sliding block (15) comprises a rectangular body (151), a strip-shaped limiting protrusion (152) and a connecting hole (153); the body (151) is correspondingly connected with the through slot (4); the limiting protrusion (152) is disposed on a top part of the body (151); the connecting hole (153) passes through the body (151); the limiting protrusion (152) has a first end which is provided with a trapezium-shaped block (154).

7. The quick detaching device for handgun tactical light as in claim 6, wherein the connecting rod (132) has an outer diameter which is smaller than an aperture diameter of the elastic member (14); the elastic member (14) is sleeved on the connecting rod (132); the connecting rod (132) sequentially passes through the elastic member (14) and the stopping plate (5).

8. The quick detaching device for handgun tactical light as in claim 6, wherein the threaded rod (133) has an outer diameter which is smaller than an aperture diameter of the connecting hole (153); the connecting rod (132) has an outer diameter which is larger than the aperture diameter of the connecting hole (153); the threaded rod (133) passes through the connecting hole (152) to correspondingly connect with the fixing nut (16).

9. The quick detaching device for handgun tactical light as in claim 4, wherein the spring plate (7) is made of a polymer material which comprises the following components in parts by mass:

| | |
|---|---|
| Ceramic powder | 15-40 parts, |
| Carbon fiber | 60-90 parts, |
| Epoxy resin | 20-30 parts, |
| Adjuvant | 20-30 parts. |

10. The quick detaching device for handgun tactical light as in claim 9, wherein the adjuvant comprises 10-15 parts of plasticizer and 15-20 parts of a curing agent in parts by mass; the plasticizer is a mixture of phthalic anhydride and trimellitic anhydride; the curing agent is diaminodichlorodiphenylmethane; the ceramic powder comprises polyurethane resin with a mass fraction of 15-17% and TiN with a mass fraction of 9-11%; the polyurethane resin is prepared by toluene diisocyanate as raw material.

* * * * *